US009920665B2

(12) United States Patent
Kwon et al.

(10) Patent No.: US 9,920,665 B2
(45) Date of Patent: Mar. 20, 2018

(54) CONTINUOUS VARIABLE VALVE DURATION APPARATUS AND CONTROL METHOD USING THE SAME

(71) Applicant: Hyundai Motor Company, Seoul (KR)

(72) Inventors: Kiyoung Kwon, Yongin-si (KR); Ingee Suh, Yongin-si (KR); Kyoung Pyo Ha, Seoul (KR); In Sang Ryu, Hwaseong-si (KR); Back Sik Kim, Osan-si (KR)

(73) Assignee: Hyundai Motor Company, Seoul (KR)

( * ) Notice: Subject to any disclaimer, the term of this patent is extended or adjusted under 35 U.S.C. 154(b) by 215 days.

(21) Appl. No.: 14/724,316

(22) Filed: May 28, 2015

(65) Prior Publication Data

US 2016/0153324 A1 Jun. 2, 2016

(30) Foreign Application Priority Data

Nov. 28, 2014 (KR) ..... 10-2014-0169045

(51) Int. Cl.
*F01L 13/00* (2006.01)
*F01L 1/053* (2006.01)
(Continued)

(52) U.S. Cl.
CPC ..... *F01L 13/0015* (2013.01); *F01L 1/0532* (2013.01); *F01L 1/356* (2013.01); *F01L 13/0026* (2013.01); *F01L 13/06* (2013.01); *F01L 2001/0476* (2013.01); *F01L 2001/0535* (2013.01); *F01L 2013/0084* (2013.01); *F01L 2800/00* (2013.01); *F01L 2820/032* (2013.01); *F02D 13/04* (2013.01)

(58) Field of Classification Search
CPC ..... F01L 13/0015; F01L 1/0532; F01L 2001/0535; F01L 2013/0084; F01L 2800/00; F01L 13/0036; F01L 1/267; F01L 13/06; F01L 2800/08; F01L 2820/045; Y02T 10/18; Y02T 10/42; F02D 2041/001; F02D 41/0002; F02D 13/0207; F02D 13/0203; F02D 13/0261
USPC ..... 123/345–347
See application file for complete search history.

(56) References Cited

U.S. PATENT DOCUMENTS 4,938,199 A * 7/1990 Sato ..... F02D 41/045 123/327
5,495,830 A * 3/1996 Wu ..... F01L 3/205 123/184.47
(Continued)

FOREIGN PATENT DOCUMENTS

JP H07116981 B * 12/1995 ..... F02D 43/00
JP 9-68060 A 3/1997
(Continued)

*Primary Examiner* — Marguerite McMahon
*Assistant Examiner* — Tea Holbrook
(74) *Attorney, Agent, or Firm* — Morgan, Lewis & Bockius LLP

(57) ABSTRACT

A control method using a continuous variable duration apparatus provided to adjust opening duration of an intake valve of an engine may include: setting a desired deceleration speed when a vehicle starts decelerating, determining a pumping loss by the engine that is required for the desired deceleration speed, setting desired duration for the required pumping loss by the engine, and controlling duration of the intake valve on the basis of the set desired duration.

4 Claims, 9 Drawing Sheets

(51) Int. Cl.

| | |
|---|---|
| ***F01L 13/06*** | (2006.01) |
| ***F01L 1/356*** | (2006.01) |
| *F01L 1/047* | (2006.01) |
| *F02D 13/04* | (2006.01) |

(56) References Cited

U.S. PATENT DOCUMENTS

| | | | | |
|---|---|---|---|---|
| 6,192,857 | B1 * | 2/2001 | Shimada | F01L 9/04 123/295 |
| 2007/0192018 | A1 * | 8/2007 | Gibson | F02D 13/04 701/110 |
| 2008/0059031 | A1 * | 3/2008 | Yasui | F01L 1/185 701/51 |
| 2013/0018548 | A1 * | 1/2013 | Shimasaki | B60L 1/02 701/36 |
| 2014/0202423 | A1 * | 7/2014 | Carvignese | F02D 41/042 123/321 |
| 2015/0019106 | A1 * | 1/2015 | Cunningham | F02D 13/0207 701/102 |
| 2015/0211961 | A1 * | 7/2015 | Ueno | F02D 13/0261 73/114.22 |
| 2015/0240671 | A1 * | 8/2015 | Nakamura | F02D 13/0211 123/90.16 |
| 2017/0045001 | A1 * | 2/2017 | Haizaki | F02D 13/02 |

FOREIGN PATENT DOCUMENTS

| | | | | | |
|---|---|---|---|---|---|
| JP | 2003-106176 | A | | 4/2003 | |
| JP | 2004162602 | A | * | 6/2004 | F02D 41/12 |
| KR | 10-2011-0043709 | A | | 4/2011 | |
| KR | 10-2011-0050384 | A | | 5/2011 | |
| KR | 10-2013-0063819 | A | | 6/2013 | |

* cited by examiner

CONTINUOUS VARIABLE VALVE DURATION APPARATUS AND CONTROL METHOD USING THE SAME

CROSS-REFERENCE TO RELATED APPLICATION

The present application claims priority to and the benefit of Korean Patent Application No. 10-2014-0169045 filed on Nov. 28, 2014, the entire contents of which is incorporated herein for all purposes by this reference.

BACKGROUND OF THE INVENTION

Field of the Invention

The present invention relates to a continuous variable valve duration apparatus and a control method using the same. More particularly, the present invention relates to a continuous variable valve duration apparatus that can change opening duration of a valve with a simple configuration in accordance with the operational states of an engine, and a control method using the continuous variable valve duration.

Description of Related Art

In general, internal combustion engines generate power by receiving and burning air and fuel in a combustion chamber. When an intake valve is operated by a camshaft, air is drawn into the combustion chamber while the intake valve is open. Further, when an exhaust valve is operated by the camshaft, air is discharged from the combustion chamber while the exhaust valve is open.

The optimum operation of the intake valve/exhaust valve, however, depends on the RPM of the engine. That is, the appropriate time for lifting or opening/closing the valves depends on the RPM of the engine. In order to implement an appropriate valve operation in accordance with the RPM of the engine, as described above, a CVVL (Continuously Variable Valve Lift) apparatus that has a plurality of shapes of cams operating valves or operates valves at different lifts in accordance with the RPM of an engine has been studied.

A CVVT (Continuous Variable Valve Timing) technique has been developed to adjust the opening duration of a valve, in which the timings of opening/closing a valve are simultaneously changed with the valve duration being fixed.

However, the CVVL or the CVVT has a problem in that the configuration is complicated and the manufacturing cost is high. Further, it is not easy to control a pumping loss by an engine with the CVVT.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a continuous variable valve duration apparatus having advantages of being able to adjust duration of a valve lift in accordance with operational states of an engine, and a control method using the continuous variable valve duration apparatus.

In an aspect of the present invention, a continuous variable valve duration apparatus may include a plurality of wheels that are mounted on a camshaft, each wheel having a wheel key and corresponding to cylinders, respectively, a plurality of cam devices, wherein each of the cam devices may have cams and a cam key, and the camshaft is inserted into the cams, and wherein the cam devices may have variable relative phases of the cams with respect to the camshaft and corresponds to the cylinders, respectively, a plurality of inner brackets that are connected to the wheel key and the cam key, a plurality of slider housings in which the inner brackets are rotatably inserted, wherein the slider housings are selectively moveable vertically with respect to the engine, a controller that adjusts positions of rotational centers of the inner brackets by changing positions of the slider housings, and a guide device that guides the slider housings, wherein a pumping loss by the engine is controlled by controlling duration of a valve.

The apparatus may further include first pins having a wheel key slot into which the wheel key is slidably inserted, and second pins having a cam key slot into which the cam key is slidably inserted, wherein the inner brackets may have first and second pin holes into which the first pins and the second pins are inserted, respectively.

The first and second pins may have a shape of a cylinder, and the first and second pins are rotatably inserted into the first and second pin holes.

The wheel key slot of the first pins and the cam key slot of the second pins are formed in opposite directions.

Control teeth are formed on a side of each of the slider housings, wherein the controller may include a control shaft that is in parallel with the camshaft and may have control gears engaged with the control teeth, and an actuator that selectively rotates the control shaft.

The guide device may include a guide bar guiding the slider housings, and guide brackets fixing the guide bar, and a guide slot in which the guide bar is inserted is formed in the slider housings.

In another aspect of the present invention, a control method using a continuous variable duration apparatus provided to adjust an opening duration of an intake valve of an engine, may include setting, by a controller, a desired deceleration speed when a vehicle starts decelerating, determining, by the controller, a pumping loss by the engine that is required for the desired deceleration speed, setting, by the controller, a desired opening duration for the required pumping loss by the engine, and controlling, by the controller, the opening duration of the intake valve on a basis of the set desired opening duration.

The method may further include decelerating the vehicle on a basis of the desired deceleration speed, as the opening duration of the intake valve is controlled.

A start of deceleration of the vehicle is detected from a change in position of an accelerator pedal.

The method is ended upon an end of deceleration of the vehicle.

An end of the deceleration of the vehicle is detected from a change in a position of an accelerator pedal.

The setting of the desired opening duration and the controlling of the opening duration of the intake valve on a basis of the set desired duration are performed with an opening timing of the intake valve maximally advanced.

In further another aspect of the present invention, a control method using a continuous variable duration apparatus provided to adjust an opening duration of an intake valve of an engine, may include setting, by a controller, a desired deceleration speed when a vehicle starts decelerating, determining, by the controller, a pumping loss by the engine that is required for the desired deceleration speed, setting, by the controller, a desired opening duration for the required pumping loss by the engine, and controlling, by the controller, the opening duration of the intake valve on a basis of the set desired opening duration, wherein the continuous variable valve duration apparatus may include a plurality of wheels that are mounted on a camshaft, each wheel having a wheel key and corresponding to cylinders, respectively, a plurality of cam devices, wherein each of the cam devices may have cams and a cam key, and the camshaft is inserted into the cams, and wherein the cam devices may have variable relative phases of the cams with respect to the camshaft and corresponds to the cylinders, respectively, a plurality of inner brackets that are connected to the wheel key and the cam key, a plurality of slider housings in which the inner brackets are rotatably inserted, wherein the slider housings are selectively moveable vertically with respect to the engine, a controller that adjusts positions of rotational centers of the inner brackets by changing positions of the slider housings, and a guide device that guides the slider housings, wherein a pumping loss by the engine is controlled by controlling duration of a valve.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
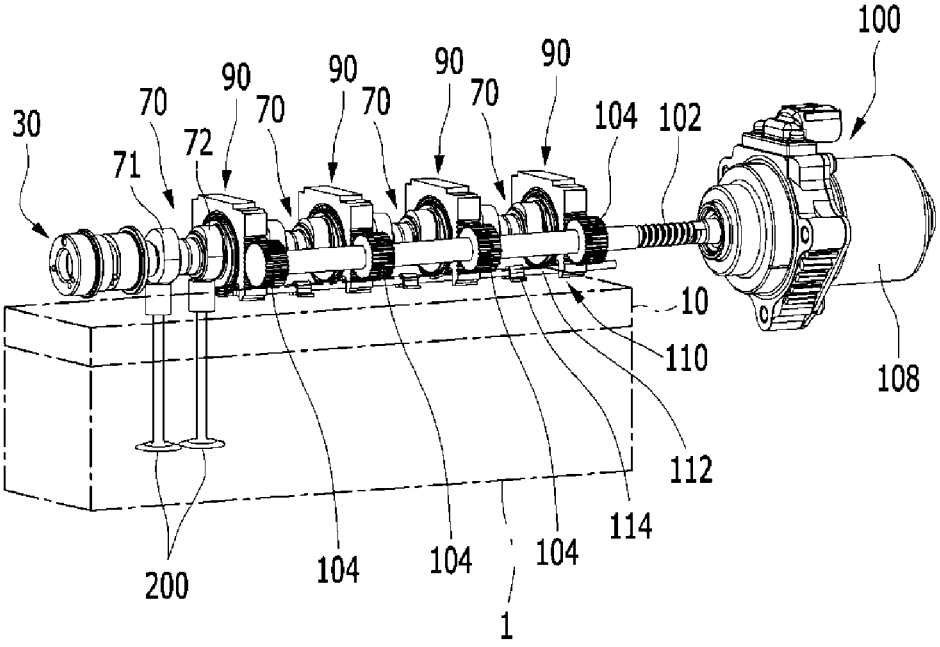
FIG. 1 is a perspective view an engine equipped with a continuous variable valve duration apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention.

Like reference numerals are given to like components throughout the specification.

Throughout the specification, unless explicitly described to the contrary, the word "comprise" and variations such as "comprises" or "comprising" will be understood to imply the inclusion of stated elements but not the exclusion of any other elements.

An exemplary embodiment of the present invention will hereinafter be described in detail with reference to the accompanying drawings.

Figure 2:
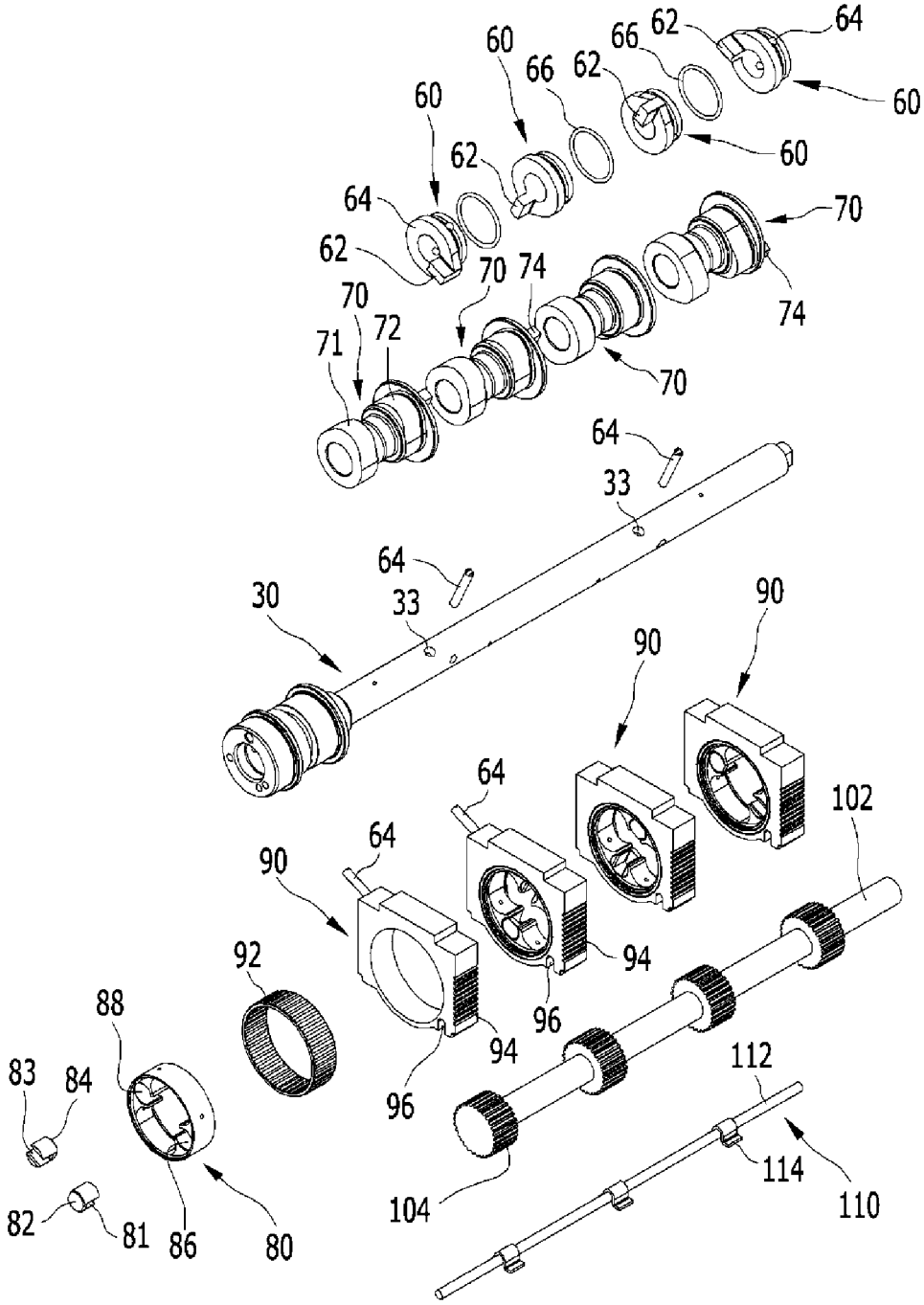
FIG. 2 is an exploded perspective view of the continuous variable valve duration apparatus according to an exemplary embodiment of the present invention.
Figure 3:
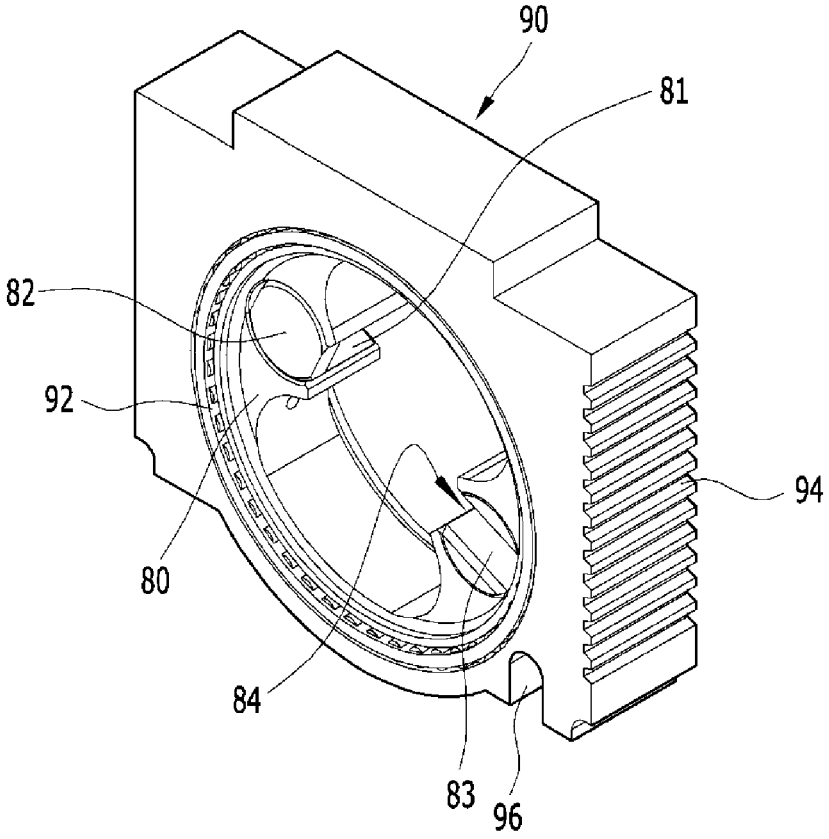
FIG. 3 and FIG. 4 are partial exploded perspective views of the continuous variable valve duration apparatus according to an exemplary embodiment of the present invention.
Figure 4:
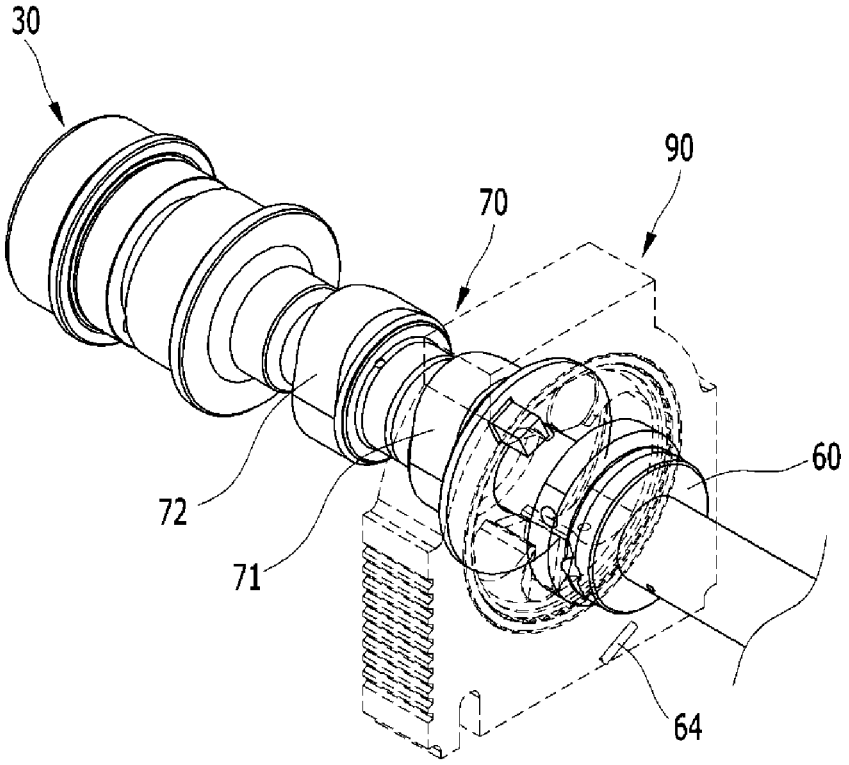

FIG. 1 is a perspective view an engine equipped with a continuous variable valve duration apparatus according to an exemplary embodiment of the present invention, FIG. 2 is an exploded perspective view of the continuous variable valve duration apparatus according to an exemplary embodiment of the present invention, and FIGS. 3 and 4 are partial exploded perspective views of the continuous variable valve duration apparatus according to an exemplary embodiment of the present invention.

Referring to FIGS. 1 to 4, an engine according to an exemplary embodiment of the present invention includes an engine block 1, a cylinder head 10 mounted on the engine block 1, and a continuous variable valve duration apparatus mounted on the cylinder head 10.

The continuous variable valve duration apparatus includes: a camshaft 30, a plurality of wheels 60 mounted on the camshaft 30, each including a wheel key 62 and respectively corresponding to cylinders, a plurality of cam devices 70 each including cams 71 and 72 and a cam key 74 in which the camshaft 30 is inserted, and that has a variable relative phase of the cams 71 and 72 with respect to the camshaft 30, and corresponds to the cylinders, respectively, a plurality of inner brackets 80 that are connected to the wheel keys 62 and the cam keys 74, a plurality of slider housings 90 in which the inner brackets 80 are rotatably inserted and that can move vertically with respect to an engine, a controller 100 that adjusts positions of the rotational centers of the inner brackets 80 by changing positions of the slider housings 90, and a guide device 110 that guides the slider housings 90.

The camshaft 30 may be an intake camshaft or an exhaust camshaft.

Although two cams 71 and 72 are provided in the drawings, the present invention is not limited thereto.

The cams 71 and 72 open/close a valve 200.

Fastening holes 33 are formed at the camshaft 30, and the wheels 60 can be combined with the camshaft 30 by connecting pins 64. Coupling springs 66 are mounted on the wheels 60, so they can prevent separation of the connecting pins 64.

The continuous variable valve duration apparatus further includes first pins 82 having a sliding key slot 81 in which the wheel key 62 is slidably inserted and second pins 84 having a sliding key slot 83 in which the cam key 74 is slidably inserted, and the inner bracket 80 has first and second pin holes 86 and 88 in which the first pin 82 and the second pin 84 are inserted, respectively.

The first and second pins 82 and 84 have the shape of a cylinder, and are rotatably inserted in the first and second pin holes 86 and 88.

Accordingly, since the first and second pins 82 and 84 and the first and second sliding pin holes 86 and 88 are formed in the shape of a cylinder, abrasion resistance can be improved.

Further, productivity can be secured by the simple shape of the first and second pins 82 and 84 and the first and second sliding pin holes 86 and 88.

The sliding key slots 81 and 83 of the first and second pins 82 and 84 are formed in opposite directions, and the wheel key 62 and the cam key 74 can be inserted therein.

The first and second pin holes 86 and 88 may be partially open in order to not interfere with movement of the wheel key 62 and the cam key 72.

A needle bearing 92 may be disposed between the slider housing 90 and the inner bracket 80, so the slider housing 90 and the inner bracket 80 can easily rotate relative to each other and rigidity can be secured.

Control teeth 94 are formed on a side of each of the slider housings 90, and the controller 100 includes a control shaft 102 that is parallel with the camshaft 30 and has control gears 104 engaged with the control teeth 94, and a motor 108 that selectively rotates the control shaft 102.

The guide device 110 includes a guide bar 112 guiding the slider housings 90 and guide brackets 114 fixing the guide bar 112, and a guide slot 96 in which the guide bar 112 is inserted is formed in the slider housings 90.

Figure 5A:
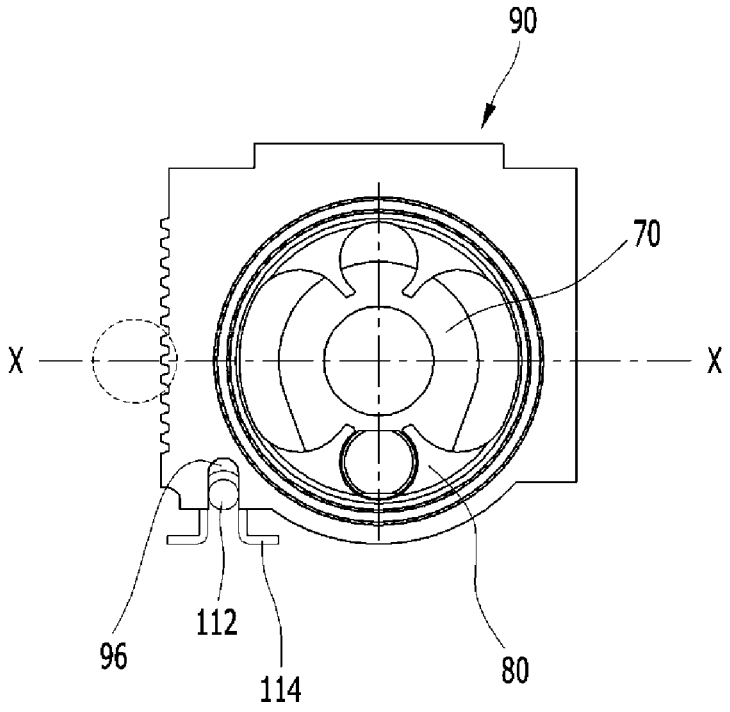
FIG. 5A.
Figure 5B:
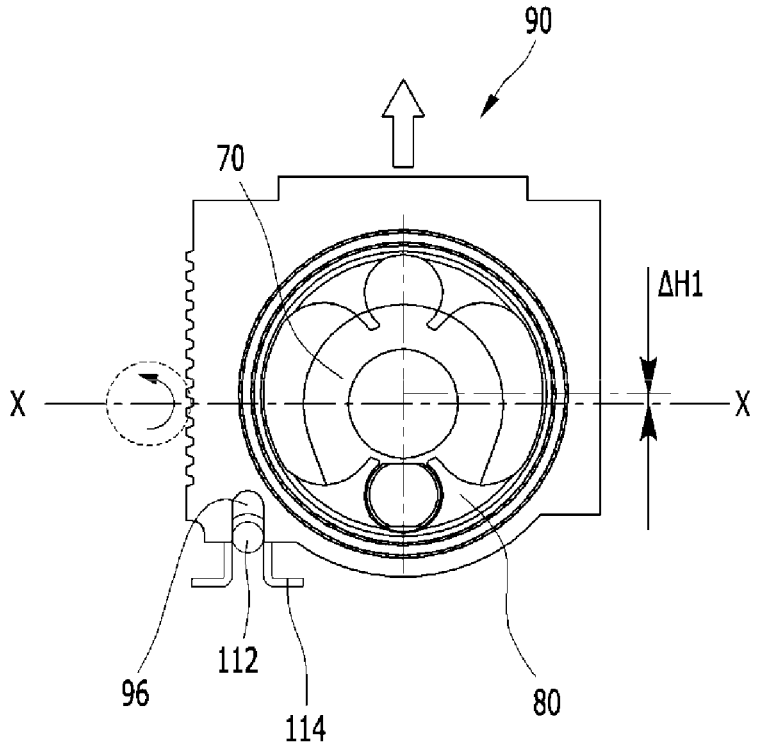
FIG. 5B, and FIG. 5C are a views illustrating the operation of the continuous variable valve duration apparatus according to an exemplary embodiment of the present invention.
Figure 5C:
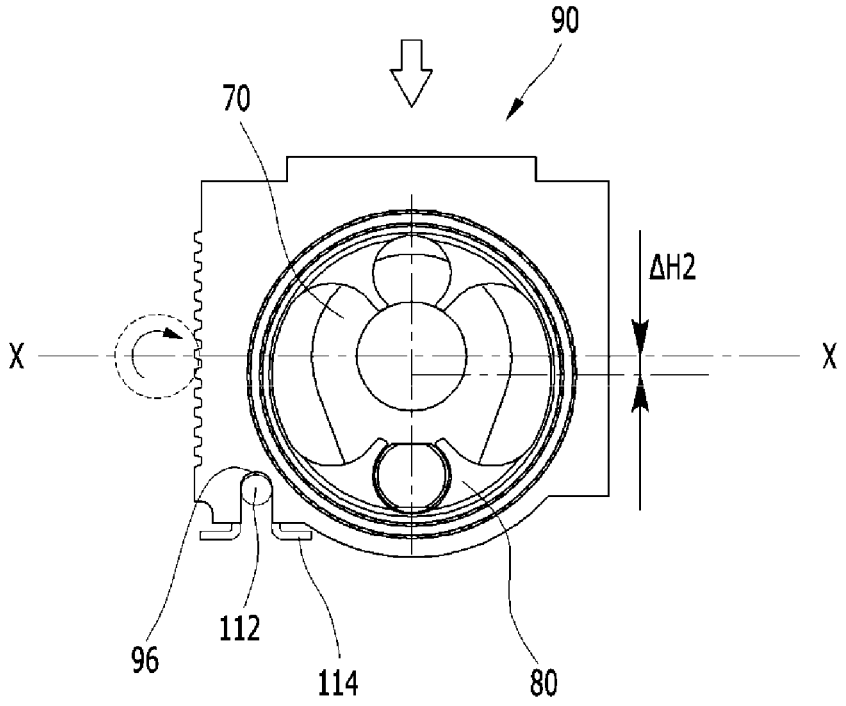
Figure 6:
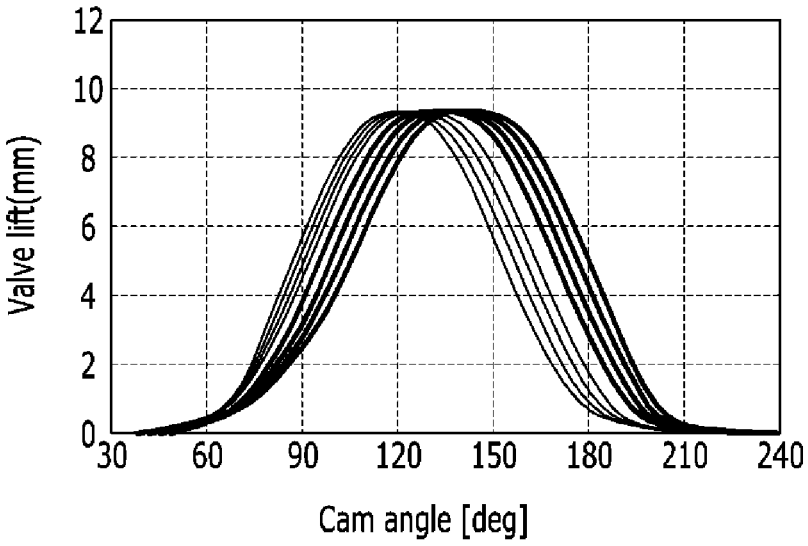
FIG. 6 is a graph showing a valve profile of the continuous variable valve duration apparatus according to an exemplary embodiment of the present invention.

FIG. 5A. FIG. 5B, and FIG. 5C are views illustrating the operation of the continuous variable valve duration apparatus according to an exemplary embodiment of the present invention, and FIG. 6 is a graph showing a valve profile of the continuous variable valve duration apparatus according to an exemplary embodiment of the present invention.

Hereinafter, the operation of the continuous variable valve duration apparatus according to an exemplary embodiment of the present invention is described with reference to FIGS. 1 to 6.

In accordance with the operational states of an engine, the motor 108 of the controller 100 operates and changes the relative positions of the slider housings 90.

For example, in FIG. 5A, as the motor 108 operates, the control shaft 102 rotates, so when the position of the slider housing 90 changes upward, the rotational center of the inner bracket 80 moves by ΔH1, as in FIG. 5B, or when the position of the slider housing 90 changes downward, the rotational center of the inner bracket 80 moves by ΔH2, as in FIG. 5C.

As the position of the rotational center of the inner bracket 80 changes, the rotational acceleration of the cam device 70 changes and valve duration changes accordingly.

As shown in FIG. 6, the maximum lift of the valve 200 is constant, and as the position of the slider housing 90 changes, the relative rotational speed of the cams 71 and 72 to the camshaft 30 changes, the timing for opening/closing the valve 200 changes, and accordingly, the duration of the valve 200 changes. On the other hand, in order to control deceleration ability of a vehicle, the duration can be adjusted with the opening timing of an intake valve maximally advanced so that a pumping loss by an engine is large.

Figure 7:
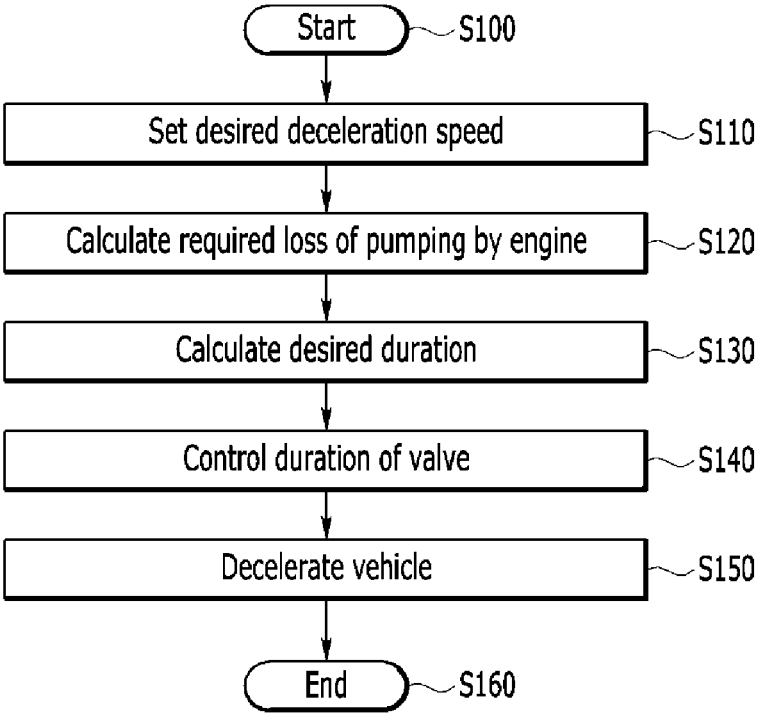
FIG. 7 is a flowchart illustrating a control method using the continuous variable valve duration apparatus according to an exemplary embodiment of the present invention.

FIG. 7 is a flowchart illustrating a control method using the continuous variable valve duration apparatus according to an exemplary embodiment of the present invention.

As shown in FIG. 7, a control method using the continuous variable valve duration apparatus according to an exemplary embodiment of the present invention improves deceleration ability of a vehicle by controlling a pumping loss by an engine.

When a vehicle starts to decelerate (S100), an ECU (Electronic Control Unit) sets a desired deceleration speed in accordance with the state of an engine and the speed of the vehicle (S110). The start of deceleration of the vehicle can be detected from a change in position of an accelerator pedal. The ECU is a common system mounted on vehicles to generally control electric devices in the vehicles and is well known to those skilled in the art, so the detailed description is not provided.

When the desired deceleration speed is set (S110), the ECU calculates a pumping loss by the engine that is required for the desired deceleration speed (S120).

When the required pumping loss by the engine is calculated (S120), the ECU sets desired duration for the required pumping loss by the engine (S130).

When the desired duration is set, the controller 100 controls the duration of the valve 200 on the basis of the set desired duration (S140). The valve 200 of which the duration is controlled may be an intake valve. Further, as the duration of the valve 200 is controlled, the vehicle is decelerated on the basis of the desired deceleration speed (S150).

The control method using the continuous variable valve duration apparatus according to an exemplary embodiment of the present invention is ended upon the end of deceleration of the vehicle (S160). The end of deceleration of the vehicle can be detected from a change in position of an accelerator pedal.

As described above, according to a continuous variable valve duration apparatus according to an exemplary embodiment of the present invention, it is possible to adjust duration of a valve lift with a simple configuration in accordance with the operational states of an engine.

The configuration of the continuous variable valve duration apparatus is relatively small, so it is possible to reduce the entire height of a valve train.

It is possible to apply the continuous variable valve duration apparatus even without excessive design change to existing common engines, so it is possible to increase productivity and reduce the manufacturing cost.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. They are not intended to be exhaustive or to limit the invention to the precise forms disclosed, and obviously many modifications and variations are possible in light of the above teachings as well as various alternatives and modifications thereof. It is intended that the scope of the invention be defined by the Claims appended hereto and their equivalents.

What is claimed is:

1. A control method using a continuous variable duration apparatus provided to adjust a duration of opening an intake valve of an engine, the method comprising:

setting, by a controller, a desired deceleration speed when a vehicle starts decelerating; determining, by the controller, a pumping loss by the engine that is required for the desired deceleration speed;

setting, by the controller, a desired duration of opening the intake valve for the required pumping loss by the engine;

controlling, by the controller, the duration of opening the intake valve on a basis of the set desired opening duration of opening the intake valve;

decelerating the vehicle on a basis of the desired deceleration speed, as the duration of opening the intake valve is controlled; and, wherein the setting of the desired duration of opening the intake valve and the controlling of the duration of opening the intake valve on a basis of the set desired duration are performed with an opening timing of the intake valve maximally advanced.

2. The method of claim 1, wherein a start of deceleration of the vehicle is detected from a change in position of an accelerator pedal.

3. The method of claim 1, wherein the method is ended upon an end of deceleration of the vehicle.

4. The method of claim 3, wherein an end of the deceleration of the vehicle is detected from a change in a position of an accelerator pedal.

* * * * *